US008241066B2

(12) United States Patent
Castiglione et al.

(10) Patent No.: US 8,241,066 B2
(45) Date of Patent: Aug. 14, 2012

(54) LIGHT SOCKET ENGAGEABLE ENERGY SAVING DEVICE

(75) Inventors: John Castiglione, San Diego, CA (US); Jason Sunstein, San Diego, CA (US)

(73) Assignee: Lisa Landau, Las Vegas, NV (US)

( * ) Notice: Subject to any disclaimer, the term of this patent is extended or adjusted under 35 U.S.C. 154(b) by 0 days.

(21) Appl. No.: 12/348,855

(22) Filed: Jan. 5, 2009

(65) Prior Publication Data

US 2009/0176395 A1 Jul. 9, 2009

Related U.S. Application Data

(60) Provisional application No. 61/018,731, filed on Jan. 3, 2008.

(51) Int. Cl.
*H01R 13/66* (2006.01)

(52) U.S. Cl. ..... 439/620.02; 315/71

(58) Field of Classification Search ..... 439/699.2, 439/257, 620.02; 362/640, 645, 647, 388; 315/56, 58, 71, 72
See application file for complete search history.

(56) References Cited

U.S. PATENT DOCUMENTS

| | | | | | |
|---|---|---|---|---|---|
| 3,617,766 | A * | 11/1971 | Kahn | 307/146 |
| 3,818,263 | A * | 6/1974 | Belko | 315/32 |
| 4,350,931 | A * | 9/1982 | Niskin | 315/72 |
| 4,435,671 | A * | 3/1984 | Wouk | 315/200 R |
| 4,513,182 | A * | 4/1985 | Juntti | 200/51.09 |
| 4,980,607 | A * | 12/1990 | Albert et al. | 315/71 |
| 5,214,354 | A * | 5/1993 | Johnson | 315/71 |
| 5,731,663 | A * | 3/1998 | Davis | 315/194 |
| 7,063,553 | B1 * | 6/2006 | Mullen | 439/336 |

* cited by examiner

*Primary Examiner* — Michael Zarroli
(74) *Attorney, Agent, or Firm* — Donn K. Harms

(57) ABSTRACT

An energy saving apparatus adapted for insertion between the center conductor of a lightbulb, and the center electrical contact of a light bulb socket. The device features an electrical component for varying or decreasing the amount of electrical current reaching the light bulb. The electrical component is situated in a central aperture of a collar and is surrounded by the collar which centers it in position within the light socket between the center conductor and the electrical contact of the socket. The collar has an exterior circumference which may be varied to adapt it to fit within a plurality of different sized light bulb sockets.

16 Claims, 1 Drawing Sheet

LIGHT SOCKET ENGAGEABLE ENERGY SAVING DEVICE

This application claims the benefit of U.S. Provisional Application Ser. No. 61/018,731 filed Jan. 03, 2008 and incorporated herein in its entirety by reference.

FIELD OF INVENTION

This invention relates generally to energy conservation. More particularly, it relates to a device adapted for insertion into a light socket as an interface between the bulb conducting end and the electrical power contacts in the socket. The device may be provided in a kit form that may be user-assembled into a plurality of diameters for different sized sockets, or may be provided in a single unit with frangible portions about the exterior circumference which are removable to adapt the size to the desired light socket. In all modes of the device a positive engagement to the bulb is preferred to prevent the user from having to drop the device into the socket and risk injury or short circuits.

BACKGROUND

Currently in the U.S. and throughout the world, lighting is primarily provided by incandescent bulbs which screw into light sockets. Such bulbs which are primarily resistive in operation emit light when a conductor inside a sealed globe is heated. The gas in the globe is inert and prevents the conductor or filament from burning out. Other bulbs in more recent years have appeared and use a fluorescent tube to emit light once the interior coating is excited by the electrical power at the proper frequency.

In both cases, the bulbs are capable of running on less electricity with minimal or user-indistinguishable loss of lighting brightness. Dimmers and transformers have been used to initiate such energy savings. However, such dimmers and transformers and other inline devices are hard to employ because they must be hardwired into the system which is far beyond most user's abilities.

Accordingly, there is an unmet need for a device and method which will provide users of light bulbs with a means to reduce the power consumption of those bulbs without the need to hard-wire any components. Such a device should be employable with virtually any wattage lightbulb. Further, such a device should be easily inserted in-between the bulb using the power, and the power contacts which energized the bulb in a bulb socket. Additionally, one device should be easily employable with a variety of different diametered sockets to allow sales of one component that the user may easily alter to fit the appropriate diametered bulb socket such as a candelabra, a decorative wall light, or a standard sized bulb in a ceiling fixture.

SUMMARY OF THE INVENTION

There is disclosed and described herein a device which is easily positioned inline, between any sized lightbulb and within the socket in which it electrically engages. In a particularly preferred mode of the device allowing it to adapt to a wide variety of light bulb fixtures, an energy saving component which can include a diode or other means to effect the current reaching the bulb, or a small electrical chopping circuit, or other means for reducing the energy flowing to the bulb, is engaged within a collar. The collar has an exterior circumference which is specifically adapted to slide into the light socket and hold the device centered in an electrically operable position between the bulb and the centered electrical component providing current to the bulb. So centered, the device will treat the electrical current passing through the device before reaching the bulb.

The collar surrounding the engaged electric component has an exterior circumference adapted to slide into the sidewall of the intended light socket. For instance, a small decorative bulb base would employ a small diameter collar whereas the standard lightbulb having a larger base would employ a larger diametered collar portion. The collar may be formed of plastic or substantially rigid material or it may be formed of compressible material which will naturally compress at an even rate around the circumference and center the device in the proper position in the socket.

While the collar portion is adapted to slide into the intended socket, either with the correct circumference or with an evenly compressible material forming the collar, the electrical component is always engaged in the center of the collar in a position to interface between the bottom of the bulb and the top of the socket base where the conductor is located. This allows for a single sized or type of electrical component to always be centered in an intended socket. Thus, the collar provides a means to position the device centered within virtually any socket having an interior circumference larger than that of the device.

One particularly preferred mode of the device employs a kit form wherein the components are provided and may be assembled by the user. The electrical component and a plurality of different sized collars are provided to fit a plurality of different sized sockets having different interior circumferences. The user stretches the appropriate diamatered collar over the electrical component prior to insertion into the intended socket and the bias of the collar around the device holds it in place. Or the size of the centered hole in the collar may be equal to or slightly smaller than that of the device allowing a frictional engagement therein.

In an especially preferred mode of the device herein, it is provided already assembled with the evenly compressible collar portion engaged to the centered electrical component. The material forming the collar can be compressed to fit the socket, or in a most preferred mode of the device adapted to fit virtually any sized socket, the collar portion is formed with frangible portions. The frangible portions may then be removed as needed to change the outer circumference of the collar to mate with the inner circumference of the intended socket. In this mode, providing the collar with a plurality of frangible portions will allow the device to fit virtually any sized light socket. The user simply removes one or more frangible portions from the exterior to make the exterior circumference of the collar have a diameter and circumference adapted to engage within the socket and concurrently center the device in an operable position.

In this respect, before explaining at least one embodiment of the device herein in detail, it is to be understood that the invention is not limited in its application to the details of construction, and to the arrangement of the components or method steps set forth in the following description or illustrated in the drawings. The invention is thus capable of other embodiments and of being practiced and carried out in various ways and in different order of execution. Also, it is to be understood that the phraseology and terminology employed herein are for the purpose of description and should not be regarded as limiting.

As such, those skilled in the art will appreciate that the conception upon which the system and method is based may readily be utilized as a basis for designing of other methods and components that are adaptable to a plurality of light socket sizes for carrying out the several purposes of the present invention. It is important, therefore, that the claims be regarded as including such equivalent construction insofar as they do not depart from the spirit and scope of the present invention and adaptations that would occur to those skilled in the art.

It is an object of this invention to provide an easily engageable energy savings device for a light socket.

It is a further object of this invention to provide such a device that also provides for a manner to adapt the circumference of the collar holding the electric component, to the inner circumference of the intended light socket.

An additional object of this invention is to provide such a device with easy to use frangible or removable portions on the collar to allow changes in its diameter and circumference.

These together with other objects and advantages which will become subsequently apparent reside in the details of the construction and method as more fully hereinafter described and claimed, reference being had to the accompanying drawings forming a part thereof, wherein like numerals refer to like parts throughout.

DETAILED DESCRIPTION OF PREFERRED EMBODIMENTS

Figure 1:
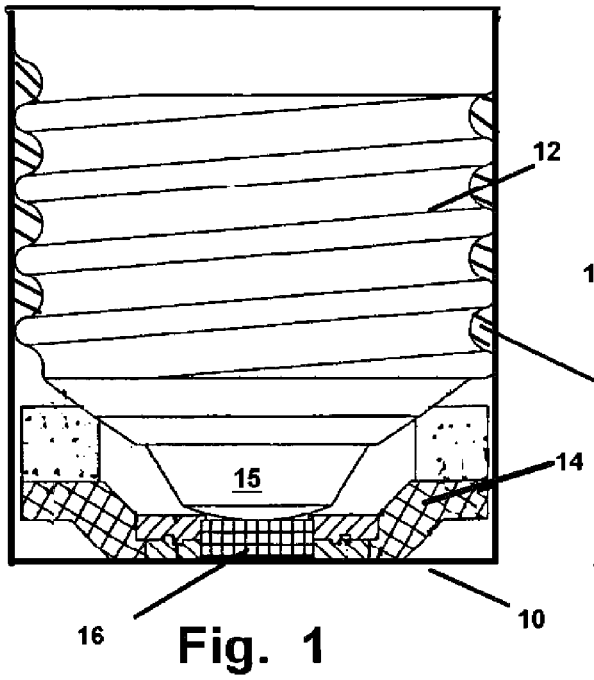
FIG. 1 depicts a side cut away view of the device as it engages with the bottom of a conventionally sized lightbulb.

Referring now to the drawings depicting the device 10 in FIGS. 1-4, wherein similar parts are identified by like referenced numerals. As noted FIG. 1 depicts a side cut away view of the device 10 as it engages upon the bottom of a conventionally sized lightbulb 12. In all the most-preferred modes of the device 10, a collar portion 14 is provided.

In a particularly preferred mode of the device, the collar portion 14 is adapted to stick to or attach to the bottom end of the lightbulb 12 for which it is to be used. This will allow the user to simply screw the device 10 into the socket 19 with the bulb 12. This attaching or gripping ability to the lightbulb 12 eliminates the tedious and dangerous step of the user having to position the small electrical component 16 centered in the light socket 19 with their fingers risking electrical shock or mis-positioning that could cause a short circuit.

Figure 3:
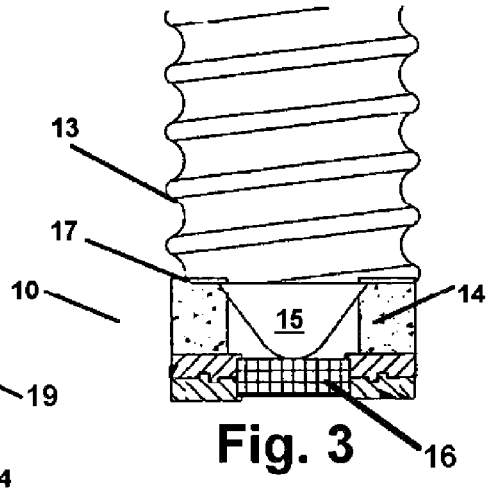
FIG. 3 is a view of FIG. 2 wherein one or more frangible portions have been removed from the circumference adapting the device to the size of the light socket.
Figure 2:
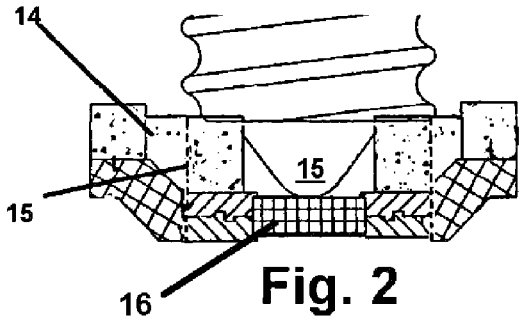
FIG. 2 depicts the device engaged upon a smaller decorative style lightbulb having a smaller screw end.

As shown in FIGS. 2 and 3 the device 10 is easily engageable in the larger sized socket 19 of FIG. 1 or engaged upon a smaller-sized socket of a decorative style lightbulb 13 having a smaller screw end for a smaller diameter socket. Here to it is desirable to employ a collar 14 that is adapted to grip onto the bulb end so that the user need not insert fingers into the socket 19. Means to attach a surface of the collar 14 to a lightbulb can be adhesive 17 such as a peel and stick type adhesive or any means that will allow one upper or top surface of the collar 14 to adhere to the bottom of the lightbulb 12 when it is removed from the socket 19 and is ready for insertion therein. Or, the collar 14 may be formed with a central cavity adapted to compress upon and grip the bulb 12 at its bottom end.

While the device 10 may be provided with a collar portion 14 custom sized to each socket as in FIG. 3, such a large variety of sizes that would be required would be confusing to consumers and require many models to be manufactured and stocked for sale. More preferred as shown in FIG. 2 is a mode of the device 10 which is manufactured having a collar with one or more frangible portions of the collar 14 that are removable. This can be done by perforations 15 communicating through the collar 14 or in other manners such as a tongue and groove engagement of the different elastic sections of the collar 14 allowing easy removal or re-engagement. Many manners of rendering sections of the collar 14 removable and/or replaceable are available and any means for removal of portions of the collar 14 that would occur to those skilled in the art are anticipated.

As noted earlier, the collar 14 may also be compressible material such that when inserted into a socket 19 having an interior circumference smaller than the exterior circumference of the collar 14, it will compress slightly and maintain the electrical component 16 centered and in electrical engagement with the light bulb 12. Or, the frangible mode of the collar 14 as in FIG. 2, may also be formed of compressible material, such that it will compress for small adjustments the circumference and diameter of the intended light socket 19, and portions may be removed to adapt it to much smaller diamatered light sockets.

Using the collar 14 having removable portions, the user would engage the collar 14 on the smaller bulb as in FIG. 2 and remove a portion or portions of the collar 14 to change the circumference and diameter to match the intended bulb 13 and still center up the electric component 16 for engagement when the collar 14 gripping the bulb 13 is inserted in a light socket. Should the collar 14 become too small to grip the bulb with elastic pressure, or should such be insufficient, adhesive 17 can also be provided such as a peel and stick surface, to insure the device 10 engages the bulb end for insertion.

Figure 4:
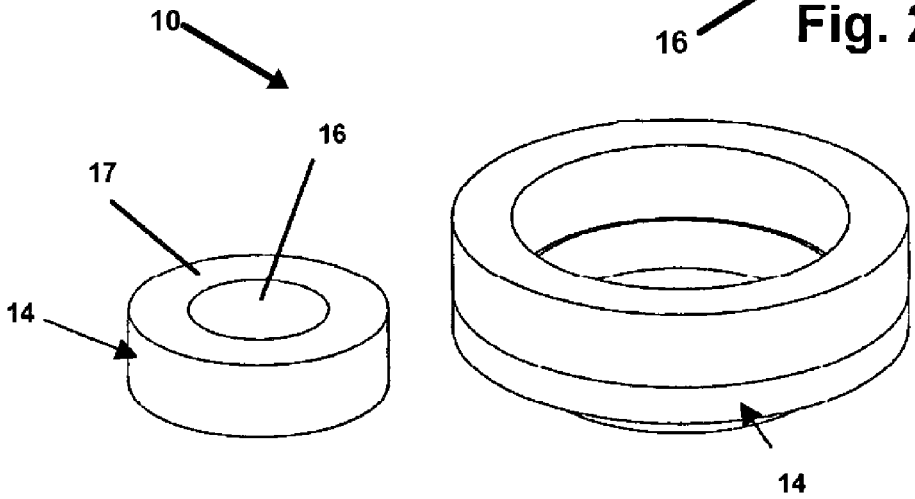
FIG. 4 depicts a kit form of the device wherein a plurality of collars may be provided to engage the electric component at a centered position.

Finally, as noted there is shown in FIG. 4 a kit form of the device wherein a plurality of collars 14 may be provided in a kit of such collars 14 all of which are adapted to engage different sockets and position the electrical component 16 in a centered position within the socket 19 and in electrical communication with the bulb 12. The collars 14 might also engage each other to assemble a larger diameter collar 14 and all would be adapted to engage and hold onto the end of the intended bulb 12. This would be done as noted above with either an elastic fit on the bulb end or adhesive 17, or a combination thereof, or other means to hold the collar 14 in position on the bulb 12 during insertion into a light bulb socket 19.

The electrical component 16 is adapted to treat or affect the electrical current communicated to the center conductor 15 of the light bulb 12 or 13 and which must travel through the electrical component 16. With modern electronic militarization, the electrical component 16 may be as simple as a diode, or may be more complicated such as a chopping circuit that will chop the electrical power reaching the bulb through the electrical component 16 and reduce the energy used by the light bulb 12. Any electrical component 16, which will reduce consumption by the bulb may be employed and all such electrical components 16 as would occur to those skilled in the art are anticipated within the scope of this application. The employment of the collar 14 in solid, compressible, or frangible forms, and optionally means to engage the collar 14 to the bulb 12, will always position the electrical component 16 in the properly centered position in the socket 19 to affect the electrical current reaching the bulb 12. Of course means to engage the collar 14 to the bulb 12 is preferred since it will alleviate the user placing their fingers in the light bulb socket 19 and the compressible and frangible collars 14 allow the most adaptability to the device 10. The kit of FIG. 4 will also provide great utility in that a single electrical component 16 may be adapted to any electrical socket 19 intended for the bulb 12.

The energy saving device adapted for engagement to a variety of different sized light bulbs 12 for insertion into engagement sockets shown in the drawings and described in detail herein features arrangements of elements of particular construction and configurations for preferred embodiments of the present invention. It is to be understood, however, that elements of different construction and configuration and other arrangements thereof, other than those illustrated and described, may be employed for providing a device within the spirit of this invention.

As such, while the present system and method of the invention has been described herein with reference to particular embodiments thereof, a latitude of modifications, various changes and substitutions are intended in the foregoing disclosure, and it will be appreciated that in some instance some features of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. An energy saving apparatus adapted for insertion between the center conductor of a lightbulb, and the center electrical contact of a light bulb socket, comprising:

an electrical component adapted to decrease electrical flow to said center conductor;

a collar, said collar having a center aperture and an external circumference surrounding said center aperture;

said collar being formed of compressible material;

said compressible material providing means to vary said external circumference to adapt said collar to engage within a plurality of different sized said light sockets;

said electrical component engaged within said center aperture; and said external circumference sized to engage within said light bulb socket and provide a means to position said electrical component in an operable position inline between said center conductor and said electrical contact of said light bulb socket.

2. The energy saving apparatus of claim 1 additionally comprising:

said collar having a central portion having said center aperture therein and having at least one annular removable portion;

said annular removable portion when engaged defining a first said external circumference;

said annular removable portion when removed, exposing a second exterior circumference of said central portion;

said second exterior circumference sized to fit a smaller said light socket than said first said external circumference; and said annular removable portion providing means to configure said collar to position said electrical component in a plurality of differently sized said light sockets when said compressible material forming said collar will not sufficiently compress to accommodate a said light socket smaller than said first external circumference.

3. The energy saving apparatus of claim 1 additionally comprising:

said collar having a first surface opposite a second surface and having a body therebetween; and means to attach said first surface to a portion of said lightbulb adjacent to said center conductor thereby providing means to attach said collar to said lightbulb and allow insertion thereof into said light socket using said light bulb as a means to prevent a finger insertion by said user into said light socket.

4. The energy saving apparatus of claim 2 additionally comprising:

said collar having a first surface opposite a second surface and having a body therebetween; and means to attach said first surface to a portion of said lightbulb adjacent to said center conductor thereby providing means to attach said collar to said lightbulb and allow insertion thereof into said light socket using said light bulb as a means to prevent a finger insertion by said user into said light socket.

5. The energy saving apparatus of claim 1 additionally comprising:

a plurality of said collars provided as members of a kit of said collars;

said members of said kit having a differently sized said external circumference; and said members of said kit thereby providing means to position a said electrical component in a centered position within a plurality of differently sized said light sockets.

6. The energy saving apparatus of claim 3 additionally comprising:

a plurality of said collars provided as members of a kit of said collars;

said members of said kit having a differently sized said external circumference; and said members of said kit thereby providing means to position a said electrical component in a centered position within a plurality of differently sized said light sockets.

7. The energy saving apparatus of claim 4 additionally comprising:

a plurality of said collars provided as members of a kit of said collars;

said members of said kit having a differently sized said external circumference; and said members of said kit thereby providing means to position a said electrical component in a centered position within a plurality of differently sized said light sockets.

8. The energy saving apparatus of claim 1 additionally comprising:

said electrical component being one of a group consisting of a diode and a electrical current chopping circuit.

9. The energy saving apparatus of claim 2 additionally comprising:

said electrical component being one of a group consisting of a diode and a electrical current chopping circuit.

10. The energy saving apparatus of claim 3 additionally comprising:

said electrical component being one of a group consisting of a diode and a electrical current chopping circuit.

11. The energy saving apparatus of claim 4 additionally comprising:

said electrical component being one of a group consisting of a diode and a electrical current chopping circuit.

12. An energy saving apparatus adapted for insertion between the center conductor of a lightbulb, and the center electrical contact of a light bulb socket, comprising:

an electrical component adapted to decrease electrical flow to said center conductor;

a collar, said collar having a center aperture and an external circumference surrounding said center aperture;

said electrical component engaged within said center aperture;

said external circumference sized to engage within said light bulb socket and provide a means to position said electrical component in an operable position inline between said center conductor and said electrical contact of said light bulb socket;

said collar having a central portion having said center aperture therein and having at least one annular removable portion;

said annular removable portion when engaged defining a first said external circumference;

said annular removable portion when removed, exposing a second exterior circumference of said central portion;

said second exterior circumference sized to fit a smaller said light socket than said first said external circumference; and said annular removable portion providing means to configure said collar to position said electrical component in a plurality of differently sized said light sockets.

13. The energy saving apparatus of claim 12 additionally comprising:

said collar having a first surface opposite a second surface and having a body therebetween; and means to attach said first surface to a portion of said lightbulb adjacent to said center conductor thereby providing means to attach said collar to said lightbulb and allow insertion thereof into said light socket using said light bulb as a means to prevent a finger insertion by said user into said light socket.

14. The energy saving apparatus of claim 12 additionally comprising:

a plurality of said collars provided as members of a kit of said collars;

said members of said kit having a differently sized said external circumference; and said members of said kit thereby providing means to position a said electrical component in a centered position within a plurality of differently sized said light sockets.

15. The energy saving apparatus of claim 12 additionally comprising:

said electrical component being one of a group consisting of a diode and a electrical current chopping circuit.

16. The energy saving apparatus of claim 13 additionally comprising:

said electrical component being one of a group consisting of a diode and a electrical current chopping circuit.

* * * * *